US005808406A

United States Patent [19]

Choi

[11] Patent Number: 5,808,406

[45] Date of Patent: Sep. 15, 1998

[54] IN-LINE ELECTRON GUN WITH NON-CIRCULAR APERTURES

[75] Inventor: Jin-Yeal Choi, Seoul, Rep. of Korea

[73] Assignee: LG Electronics Inc., Seoul, Rep. of Korea

[21] Appl. No.: 682,090

[22] Filed: Jul. 17, 1996

[30] Foreign Application Priority Data

Jul. 28, 1995 [KR] Rep. of Korea ..... 1995-22931

[51] Int. Cl.[6] ..... H01J 29/51

[52] U.S. Cl. ..... 313/412; 313/414; 313/409; 313/417; 313/421

[58] Field of Search ..... 313/413, 414, 313/412, 449, 417, 409, 421, 448, 411, 447

[56] References Cited

U.S. PATENT DOCUMENTS

| | | | |
|---|---|---|---|
| 4,086,513 | 4/1978 | Evans, Jr. . | |
| 4,599,534 | 7/1986 | Shirai et al. . | |
| 4,766,344 | 8/1988 | Say | 313/414 |
| 4,990,822 | 2/1991 | Guzowski et al. | 313/414 |

*Primary Examiner*—Sandra L. O'Shea
*Assistant Examiner*—Joseph Williams

[57] ABSTRACT

An in-line electron gun includes an electron beam forming area formed with first and second grids, a main electrostatic focusing lens with first and second accelerating/focusing electrodes, and a shield cup. The first accelerating/focusing electrode is formed in a horizontally elongated rectangular hole and has an elliptical electrode in which electron beam passing holes are formed. The second accelerating/focusing electrode is formed in a horizontally elongated rectangular hole, and the shield cup has a bottom in which non-circular holes are formed.

16 Claims, 7 Drawing Sheets

IN-LINE ELECTRON GUN WITH NON-CIRCULAR APERTURES

BACKGROUND OF THE INVENTION

The present invention relates to an in-line electron gun for a color cathode ray tube, and more particularly, to an in-line electron gun for a color cathode ray tube, in which a correction electrode and elliptical electrode are not additionally offered and the diameter of lens is effectively expanded to improve convergence and astigmatism.

Generally, as shown in FIG. 1, a conventional electron gun for a color cathode ray tube is made to have, from the bottom of the electron gun, a cathode 4 fixed by a cathode support 2, first, second and third grid electrodes 5, 6 and 7, and first and second accelerating/focusing electrodes 8 and 9 sequentially fixed by two bead glasses 10. A heater 3 welded to heater support 1 and inserted into cathode 4 acts to emit thermions from the cathode 4. Third grid electrode 7 of a rectangularly long cylinder placed in front of first and second grids 5 and 6 is connected to first accelerating/focusing electrode 8.

In this configuration, beams are horizontally distorted due to the deflection aberration and the diameter of a main electrostatic focusing lens limited by the first and second accelerating/focusing electrodes 8 and 9, which are designed to form the main electrostatic focusing lens. This decreases the resolution of a color cathode ray tube.

In order to overcome such a drawback, there was suggested in U.S. Pat. No. 4,599,534, as shown in FIG. 2, an electron group having horizontally elongated holes formed on the opposite surfaces of first and second accelerating/focusing electrodes 11 and 12 and surrounded by upper rims 15 and 16 extending from the side walls 11*a* and 12*a* of the electrodes, and elliptical electrodes 13 and 14 spaced apart from the upper rims 15 and 16 by a predetermined distance and having three vertically elongated electron beam passing holes.

As shown in FIG. 3, elliptical electrodes 13 and 14 are made in such a manner that central hole 13*b* extends vertically (V) more than horizontally (H). Circular electron beam passing holes 19*a*, 19*b* and 19*c* are formed on shield cup 18 welded to second accelerating/focusing electrode 12, and correction electrodes 17 of a horizontal brimmed-plate are welded on shield cup 18 toward elliptical electrode 14 in the upper and lower portions of the circular passing holes 19*a*, 19*b* and 19*c*.

In the electron gun employing elliptical electrodes 13 and 14, the convergence difference (astigmatism) between horizontal and vertical directions cannot be removed when the side beams and central beam coincide on the screen, in other words, in the dimensions of electrode satisfying static convergence.

The shape of spots generated by astigmatism on the screen is made so that it is divided into a core portion of a high electron density and a halo portion of a low electron density, as shown in FIG. 4. For this problem, as shown in FIG. 2, U.S. Pat. No. 4,086,513 employed correction electrode 17 for correcting only an astigmatism not affecting convergence.

With this correction electrode, however, the cost of electron gun is increased and spots vary the screen due to the uneven surface of the shield cup.

SUMMARY OF THE INVENTION

Therefore, in order to solve the above and other problems, it is an object of the present invention to provide an in-line electron gun for a color cathode ray tube in which an additional elliptical electrode is not installed inside the horizontally elongated rectangular holes of the second accelerating/focusing electrode, the STC and astigmatism are improved, the deflection aberration by the deflection yoke is minimized, and the diameter of lens is effectively expandable.

To accomplish the above and objects of the present invention, there is provided an in-line electron gun having an electron beam forming area formed with first and second grids, and forming a main electrostatic focusing lens with first and second accelerating/focusing electrodes, and a shield cup, the first accelerating/focusing electrode being formed in a horizontally elongated rectangular hole and having an elliptical electrode in which electron beam passing holes are formed, the second accelerating/focusing electrode being formed in a horizontally elongated rectangular hole, the shield cup having an elliptical hole and non-circular holes formed on its bottom.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE ATTACHED DRAWINGS

The present invention will become more fully understood from the detailed description given hereinbelow and the accompanying drawings which are given by way of illustration only, and thus are not limitative of the present invention and wherein.

DETAILED DESCRIPTION OF PREFERRED EMBODIMENTS

Figure 1:
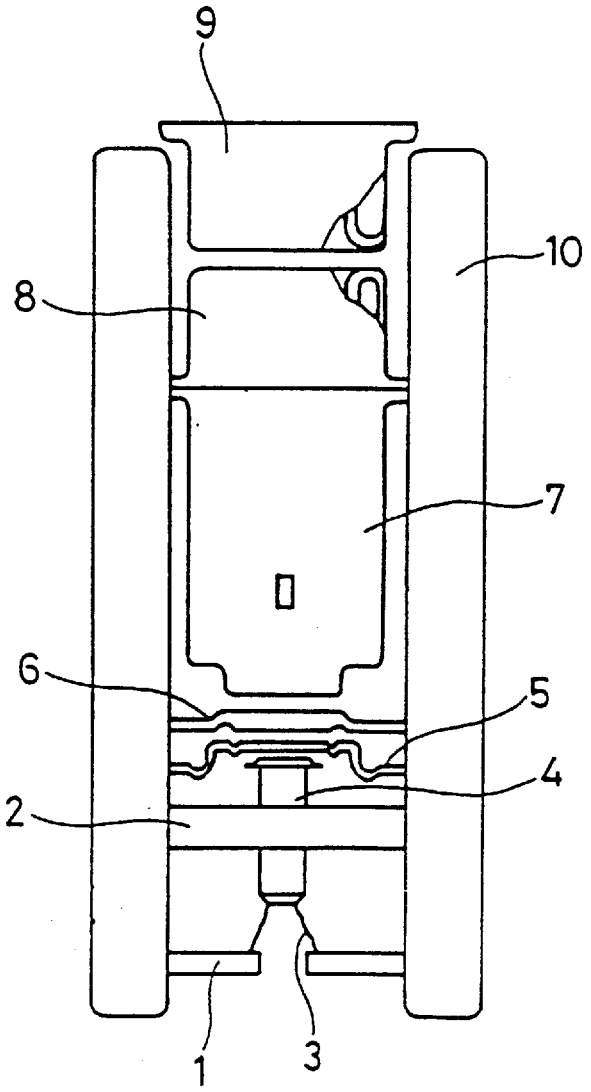
FIG 1 (PRIOR ART)
FIG. 1 shows the configuration of a conventional in-line electron gun for a color cathode ray tube.
Figure 2:
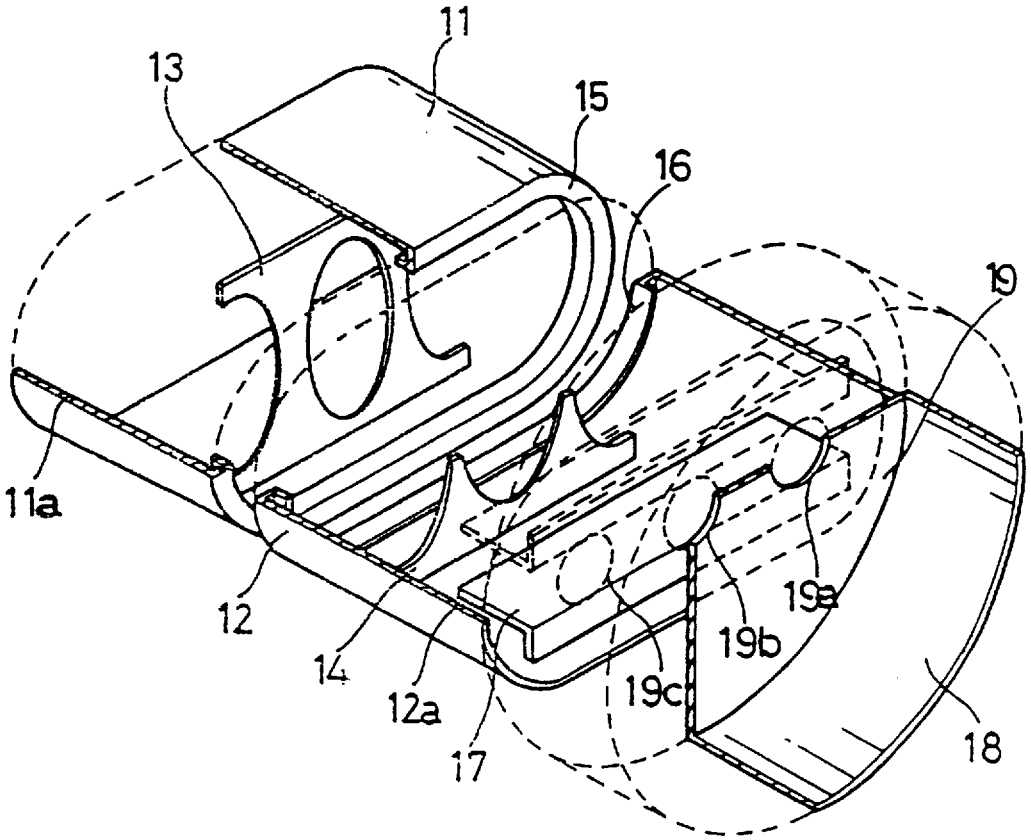
FIG 2 (PRIOR ART)
FIG. 2 is a perspective view of first and second accelerating/focusing electrodes and shield cup of the conventional in-line electron gun.
Figure 3:
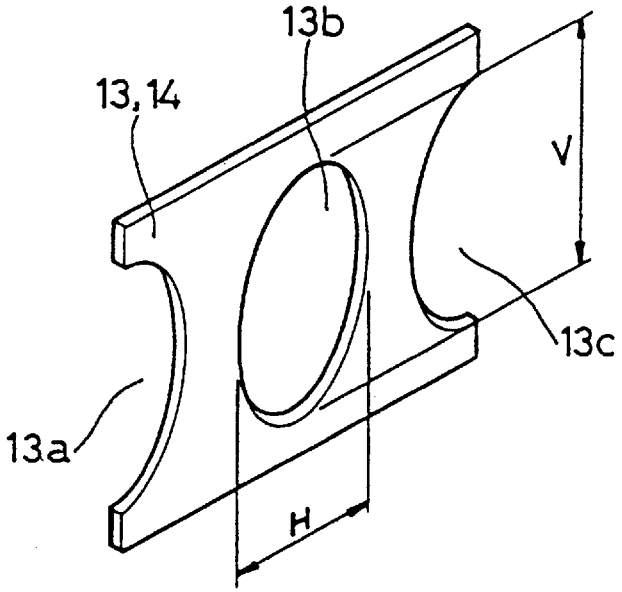
FIG. 3 is a perspective view of an elliptical electrode.
Figure 4:
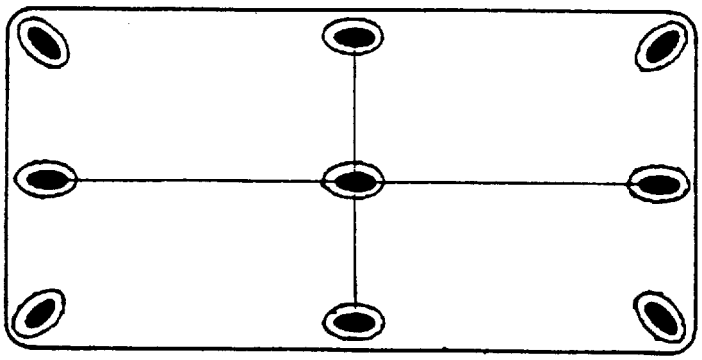
FIG 4 (PRIOR ART)
FIG. 4 shows conventional states of spots effected by astigmatism on the screen.

Referring to the drawings, the embodiments of the present invention are directed to an in-line electron gun having a cathode, first and second grids, a heater, first and second accelerating/focusing electrodes, and a shield cup. The cathode, the first and second grids, and the heater are formed as in the conventional in-line electron gun shown in FIG. 1.

Figure 5:
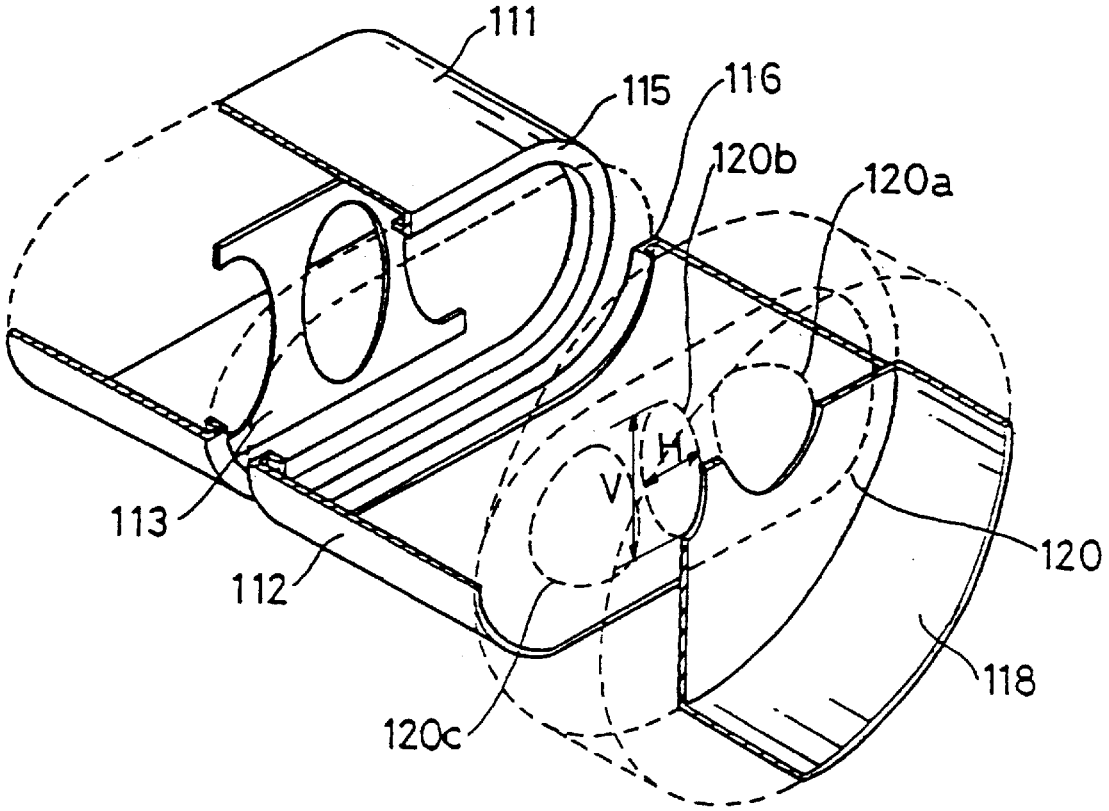
FIG. 5 is a perspective view of the electrodes of an in-line electron gun according to the embodiments of the present invention.

Referring to FIG. 5 which shows the in-line electron gun of the present invention, an elliptical electrode 113 having electron beam passing holes is placed inside a first accelerating/focusing electrode 111 of a horizontally elongated rectangular hole surrounded by upper rim 115, while spaced apart from the upper rim 115. Three holes 120*a*, 120*b*, and 120*c* extending more vertically than horizontally are formed on the bottom 120 of shield cup 118 welded to second accelerating/focusing electrode 112 which forms the main electrostatic lens along with the first accelerating/focusing electrode 111. The rim 115 of the first accelerating/focusing electrode 111 is aligned with the rim 116 of the second accelerating/focusing electrode 112.

Figure 6:
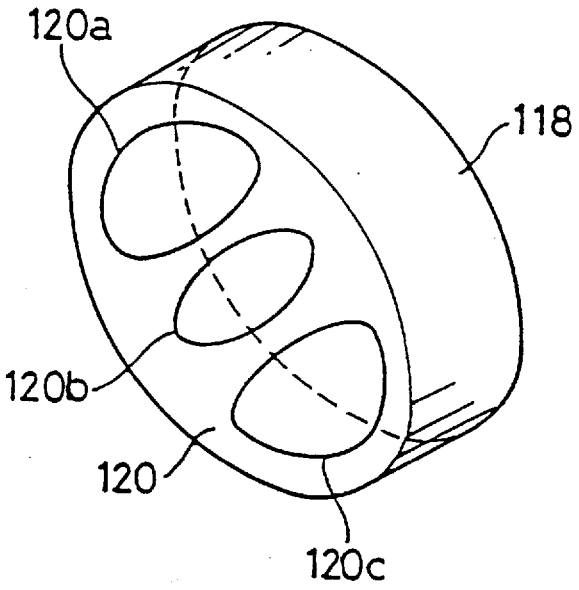
FIG. 6 is a perspective view of a shield cup of the in-line electron gun according to the present invention.
Figure 7:
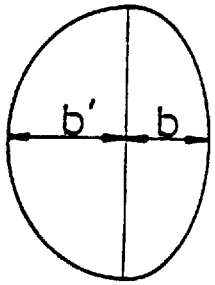
FIG. 7 shows a shape of the side hole in FIG. 6.

Among the holes 120*a*, 120*b* and 120*c* of the bottom 120 of shield cup 118, the central elliptical hole 120*b* is similar to that of the conventional elliptical electrode installed on the second accelerating/focusing electrode as shown in FIG. 6, but the side non-circular holes 120*a* and 120*c* are made in such a shape that two ellipses of different radii b and b' are coupled as shown in FIG. 7.

Figure 8:
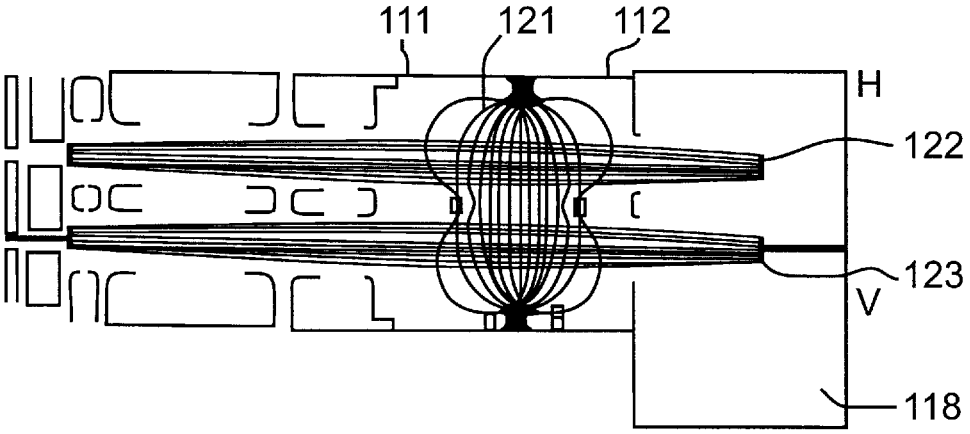
FIG. 8 is a diagram of convergence of electron beam of a main lens according to the embodiments of the present invention.

The present invention eliminates the difference in convergence between horizontal and vertical directions of main lens 121 in a state of STC in which side beams 122 and central beam 123 pass through main lens 121 to coincide at the center of the screen, as shown in FIG. 8.

Figure 9:
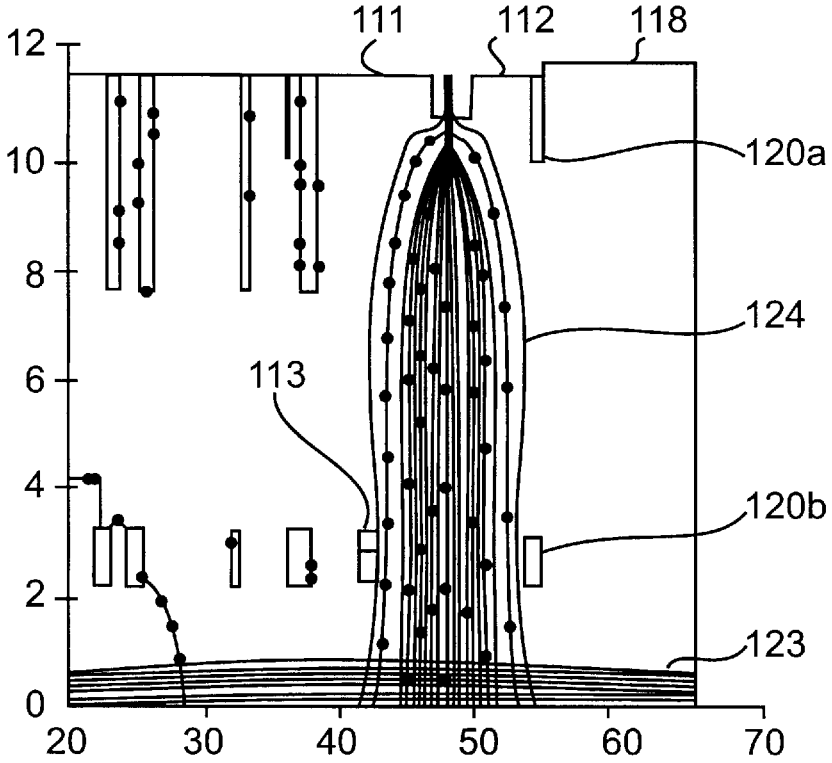
FIG. 9 is a sectional view of an equi-potential surface of the main lens according to the embodiments of the present invention.

FIG. 9 is a sectional view of the equipotential surface of the main lens when 8,000–9,000 V of a focus voltage is applied to first accelerating/focusing electrode 111 and elliptical electrode 113, and 30,000–32,000 V is applied to second accelerating/focusing electrode 112 and shield cup 118. A desired equipotential line 124 is formed by an elliptical electrode 120*b* and non-circular electrode 120*a* and 120*c* installed on the bottom 120 of the shield cup 118, thereby compensating for the STC and astigmatism.

Figure 10:
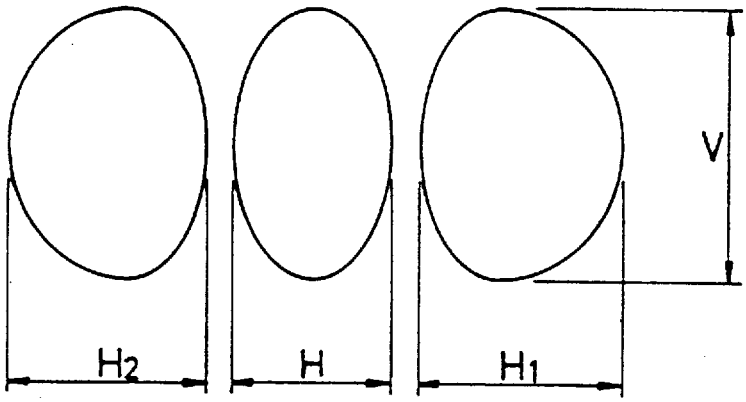
FIG. 10 shows shapes of the electrodes formed on the shield cup according to the embodiments of the present invention.

The STC and astigmatism vary considerably depending on the horizontal dimension of elliptical electrode 120. On the screen, in order to satisfy that STC is ±2 mm and the difference of astigmatism is ±200 V, $H_1=H_2=0.4\sim0.6$ V=0.4 mm~4.8 mm, H=0.2~0.4 V=0.2 mm~3.2 mm, where V=8 mm, as shown in FIG. 10.

Figure 11:
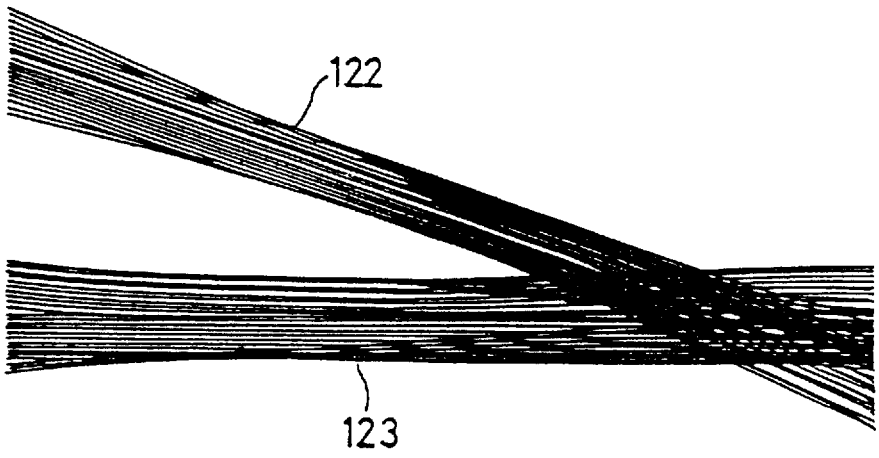
FIG. 11 is a diagram of convergence of electron beam from the main lens to the screen according to the embodiments of the present invention.

FIG. 11 shows the process of converging the electron beams emitted from the electron guns employing the main lens of the present invention into one spot on the screen. On the screen, a desired spot is obtained with the STC being +0.1 mm and the difference of astigmatism being +100 V.

As described above, the present invention improves the STC and astigmatism and reduces the distance between electron beams, minimizing the deflection aberration caused by the deflection yoke, and effectively expanding the diameter of lens.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An in-line electron gun comprising:

means for generating electron beams;

first and second accelerating/focusing electrodes for focusing the electron beams; and a shield cup connected to the second accelerating electrode and having a plurality of non-circular holes formed on a bottom portion thereof.

2. An in-line electron gun as claimed in claim 1, wherein the non-circular holes extend more vertically than horizontally.

3. An in-line electron gun as claimed in claim 1, wherein each of the non-circular holes is formed by coupling two ellipses having different radii.

4. An in-line electron gun as claimed in claim 2, wherein each of the non-circular holes is formed by coupling two ellipses having different radii.

5. An in-line electron gun as claimed in claim 1, wherein the shield cup includes an elongated hole formed between the plurality of non-circular holes.

6. An in-line electron gun as claimed in claim 1, wherein the means for generating the electron beams includes a cathode and first and second grids.

7. An in-line electron gun as claimed in claim 6, wherein the first accelerating/focusing electrode has a plurality of elliptical holes for the electron beams to pass through.

8. An in-line electron gun as claimed in claim 7, wherein the second accelerating/focusing electrode is formed in a horizontally elongated rectangular hole.

9. An in-line electron gun as claimed in claim 1, wherein at least one of the non-circular holes has a horizontal width of approximately 0.4 mm to 4.8 mm and a vertical width of approximately 8 mm.

10. An in-line electron gun as claimed in claim 5, wherein the elongated hole of the shield cup has a horizontal width of approximately 0.2 mm to 3.2 mm and a vertical width of approximately 8 mm.

11. An in-line electron gun as claimed in claim 10, wherein at least one of the non-circular holes has a horizontal width of approximately 0.4 mm to 4.8 mm and a vertical width of approximately 8 mm.

12. An in-line electron gun having an electron beam forming area formed with a cathode and first and second grids, and a main electrostatic focusing lens formed with first and second accelerating/focusing electrodes for focusing electron beams emitted from the electron beam forming area, comprising:

the first accelerating/focusing electrode being formed in a horizontally elongated hole surrounded by a rim and having an elliptical electrode in which a plurality of electron beam passing holes are formed;

the second accelerating/focusing electrode being formed in a horizontally elongated hole; and a shield cup having a bottom in which three substantially elliptical holes are formed, wherein at least one of the three substantially elliptical holes is formed by coupling two ellipses having different radii.

13. An in-line electron gun as claimed in claim 12, wherein the at least one of the three substantially elliptical holes has a horizontal width of approximately 0.4 mm to 4.8 mm and a vertical width of approximately 8 mm.

14. An in-line electron gun as claimed in claim 12, wherein the three substantially elliptical holes formed on the shield cup are two non-circular holes formed by coupling two ellipses having different radii, and an elongated hole formed between the two non-circular holes.

15. An in-line electron gun as claimed in claim 14, wherein the elongated hole formed on the shield cup has a horizontal width of approximately 0.2 mm to 3.2 mm and a vertical width of approximately 8 mm.

16. An in-line electron gun as claimed in claim 15, wherein at least one of the two non-circular holes formed on the shield cup has a horizontal width of approximately 0.4 mm to 4.8 mm and a vertical width of approximately 8 mm.

* * * * *